US007914099B2

(12) United States Patent
Loh et al.

(10) Patent No.: US 7,914,099 B2
(45) Date of Patent: Mar. 29, 2011

(54) MEDIA HANDLING SYSTEM AND METHOD

(75) Inventors: Beverly Loh, Vancouver, WA (US); Christopher M. Lesniak, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 866 days.

(21) Appl. No.: 11/724,909

(22) Filed: Mar. 15, 2007

(65) Prior Publication Data

US 2008/0225071 A1 Sep. 18, 2008

(51) Int. Cl.
*B41J 29/38* (2006.01)

(52) U.S. Cl. ..... 347/16

(58) Field of Classification Search ..... None
See application file for complete search history.

(56) References Cited

U.S. PATENT DOCUMENTS

2004/0141021 A1* 7/2004 Yamamoto et al. ..... 347/16
2006/0175747 A1* 8/2006 Boleda ..... 271/264

* cited by examiner

*Primary Examiner* — Stephen D Meier
*Assistant Examiner* — Alexander C Witkowski

(57) ABSTRACT

A media handling system for delivering media sheets to be printed from a staging location to a drum along a media path, including: at least one drive roller positioned along the media path between the staging location and the drum; a sensor positioned along the media path between the at least one drive roller and the drum; and, an encoder that provides an output responsive to the sensor; wherein, when the at least one drive roller advances a media sheet from the staging location to engage the drum, the sensor detects a position of the advancing media sheet prior to engaging the drum, and the rate of further advancing of the media sheet to engage the drum by the at least one drive roller is dependent upon the encoder output.

17 Claims, 2 Drawing Sheets

MEDIA HANDLING SYSTEM AND METHOD

FIELD OF THE INVENTION

The invention relates generally to handling sheets of media through a printing apparatus and more particularly to accurately loading staged media on a moving target.

BACKGROUND OF THE INVENTION

A media handling subsystem transports a media sheet through a printing apparatus, such as a computer printer, fax machine or copy machine, for imaging. A media sheet is picked from a stack, typically in a tray, then moved along a media path using drive rollers. Along the media path, the media sheet is positioned relative to an imaging mechanism, such as an ink or toner cartridge or printhead, which forms character and/or graphic markings on the media sheet.

For drum based printers, for example, a sheet is fed to the rotating drum by a sheet feeder, and a vacuum captures it and rolls it on to the drum. In operation, it is necessary to accurately load the staged media sheets onto the moving drum to effectively obtain media hold down. The media is loaded from the sheet feeder a fixed staged distance from the drum. The time to start moving the staged sheet of media is determined based on the expected motor ability to accelerate and paper velocity to meet the target or drum at the appropriate location. However, a number of variances may result in the operation to become misaligned. Such variances include motor speed mismatch, media thickness, and roller wear, for example. Such misalignment problems may result in increased numbers of media hold down issues, resulting in lower reliability and high numbers of jams and reduced print head lifetimes. A system and method that accurately loads the staged media onto a moving drum is desired.

SUMMARY OF THE INVENTION

A media handling system for delivering media sheets to be printed from a staging location to a drum along a media path, including: at least one drive roller positioned along the media path between the staging location and the drum; a sensor positioned along the media path between the at least one drive roller and the drum; and, an encoder that provides an output responsive to the sensor; wherein, when the at least one drive roller advances a media sheet from the staging location to engage the drum, the sensor detects a position of the advancing media sheet prior to engaging the drum, and the rate of further advancing of the media sheet to engage the drum by the at least one drive roller is dependent upon the encoder output.

BRIEF DESCRIPTION OF THE DRAWINGS

Understanding of the present invention will be facilitated by consideration of the following detailed description of the preferred embodiments of the present invention taken in conjunction with the accompanying drawings, in which like numerals refer to like parts and.

DETAILED DESCRIPTION OF THE PREFERRED EMBODIMENTS

The following description of the preferred embodiments is merely by way of example and is in no way intended to limit the invention, its application, or uses.

Figure 1:
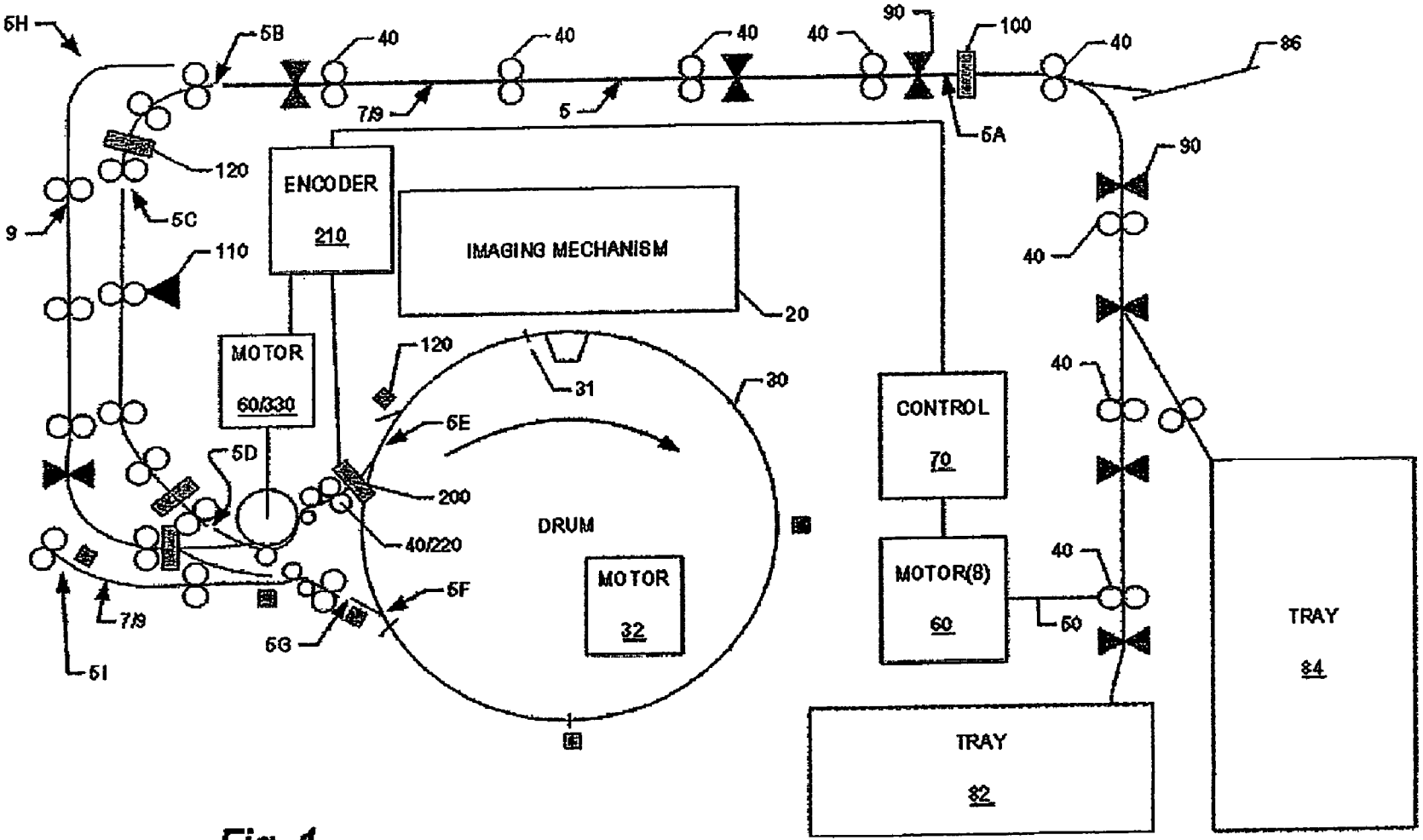
FIG. 1 illustrates a schematic view of a media path and printing apparatus according to an embodiment of the present invention; and, FIG. 2 illustrates a flow diagram of a process suitable for use with the path and apparatus of FIG. 1 and according to an embodiment of the present invention.

FIG. 1 shows a schematic view of a media path 5 through a printing apparatus 10 according to an embodiment of this invention. Apparatus 10 may take the form of a printer suitable for use with one or more computing devices, a copier, a facsimile machine or a multi-function printing apparatus that incorporates printing/copying/faxing functionalities, all by way of non-limiting example.

Apparatus 10 includes an imaging mechanism 20 for printing images on media sheets while they are supported by drum 30. The media sheets may take the form of sheets of paper, transparencies or any other substrate suitable for having images printed thereon. Mechanism 20 may take the form of a monochrome and/or color printing mechanism, and incorporate one or more print cartridges (such as cartridges that incorporate ink or toner) and/or one or more print carriages that carry one or more printheads, such as ink-jet pen print bodies, all by way of non-limiting example only. In the illustrated embodiment, drum 30 rotates and transports media sheets past imaging mechanism 20.

Apparatus 10 includes a media handling system that transports media sheets along path 5 to drum 30, and in the illustrated embodiment, receives media sheets from drum 30. The media handling system includes a plurality of drive rollers 40. Each drive roller is akin to an elastomeric "tire". The driver rollers are typically grouped about a rotating shaft 50. Each shaft 50 is typically driven by a motor 60 responsively to a media transport controller 70.

Controller 70 may typically take the form of a computing device that includes a processor. A processor generally includes a Central Processing Unit (CPU), such as a microprocessor. A CPU generally includes an arithmetic logic unit (ALU), which performs arithmetic and logical operations, and a control unit, which extracts instructions (e.g., code) from memory and decodes and executes them, calling on the ALU when necessary. "Memory", as used herein, generally refers to one or more devices capable of storing data, such as in the form of chips, tapes, disks or drives. Memory may take the form of one or more random-access memory (RAM), read-only memory (ROM), programmable read-only memory (PROM), erasable programmable read-only memory (EPROM), or electrically erasable programmable read-only memory (EEPROM) chips, by way of further example only. Memory may take the form of internal or external disc drives, for example. Memory may be internal or external to an integrated unit including a processor. Memory preferably stores a computer program or code, e.g., a sequence of instructions being operable by a processor. Controller 70 may take the form of hardware, such as an Application Specific Integrated Circuit (ASIC) and or firmware, in addition or in lieu of incorporating a processor.

The media handling system picks media sheets from stacks of one or more media sheets supported by input trays 82, 84, 86. In the illustrated embodiment, tray 86 is a manual feed tray. Media sheets picked from the trays are fed along media path 5 through the print apparatus 10 to receive printed markings by mechanism 20.

In the illustrated embodiment of the present invention there are eight (8) motors that drive shafts coupled to drive rollers, in-turn used to advance media sheets along media path 5. It may be noted that only two motors 60 are shown in FIG. 1 for purposes of explanation. In the illustrated embodiment, a first motor operates drive rollers to advance media sheets from trays 82, 84, 86 to a first position 5*a*. A second motor operates drive rollers to advance media sheets from position 5*a* to a position 5*b*. A third motor operates drive rollers to advance media sheets from position 5*b* to a position 5*c*. A fourth motor operates drive rollers to advance media sheets from position 5*c* to a position 5*d*. A fifth motor operates drive rollers to advance media sheets from position 5*d* to a position 5*e* such that the media sheets engage drum 30. Drum 30 may secure media sheets thereto via a vacuum operation, and be rotated by a drum motor 32, for example. In the illustrated embodiment drum 30 advances media sheets from position 5*e*, past imaging mechanism 20, to a position 5*f*. A sixth motor operates drive rollers to advance media sheets from position 5*f* to a position 5*g*.

In the illustrated embodiment, print apparatus 10 is configured to print single-sided media sheets in a simplex mode and double-sided media sheets in a duplex mode. In the simplex mode, media sheets travel along simplex path 7, such that only one side of the media sheet travels past imaging mechanism 20. In duplex mode, media sheets travel along a duplex path 9, such that a first side of the media sheets pass by mechanism 20 in a first pass, and a second side of the media sheets pass by mechanism 20 on a second pass. In between the first and second passes, each media sheet is flipped, such that the first printed side of the media sheet abuts drum 30 as the media sheet travels along the second pass. It will be appreciated that printing mechanisms utilizing other simplex and duplex paths may be utilized.

In the duplex mode, a seventh motor operates drive rollers to advance media sheets from position 5*g* to a position 5*h*. In the illustrated embodiment, the seventh motor also advances the media sheets from the position 5*h* to the position 5*d*, so the second side of the media may be printed on by mechanism 20.

After again traversing drum 20 to position 5*g*, and in the simplex mode, an eighth motor operates drive rollers to advance media sheets from position 5*g* to a position 5*i*, from which printed media sheets are ejected.

Apparatus 10 includes a plurality of sensors positioned along media path 5. The sensors may operate in conjunction with controller 70. In the illustrated embodiment, apparatus 10 includes flag sensors 90, a type sensor 100, a thickness sensor 110 and optical sensors 120. Each of the sensors may be operatively coupled to controller 70. In the illustrated embodiment, flag sensors 90 are used in conjunction with controller 70 to determine a media sheet's progression along path 5 by rollers 40. In the illustrated embodiment, type sensor 100 is used in conjunction with controller 70 to determine the type of media that is advancing along path 5. For example, sensor 100 may be used to determine whether a then advancing media sheet is a transparency. In the illustrated embodiment, thickness sensor 110 is used in conjunction with controller 70 to determine a thickness of a then advancing media sheet. Finally, in the illustrated embodiment, optical sensors 120 are used in conjunction with controller 70 to also determine a media sheet's progression along path 5.

In one embodiment, each flag sensor 90 comprises a lever biased to a first position in which it does not close a light circuit between an optical emitter and optical detector. In one embodiment, the lever is mounted so that gravity biases it to the first position. In another embodiment, the lever is spring-biased to the first position. The biasing force (e.g., gravity, spring tension) is sufficiently minimal, however, so that a media sheet traversing along path 5 past flag sensor 90 tips the lever and pushes it into a tripped, second position in which it closes the light circuit. Each lever may be made of conventional lightweight materials used in print apparatus components. Although a rotatable lever is described to embody a flag sensor, other mechanical structures responding to the media sheet traversing along path 5 may be used.

In one embodiment of the present invention, each optical sensor 120 includes a light source and a light detector. Exemplary light sources include a photo-emitter, LED, laser diode, super luminescent diode and fiber optic source. Exemplary light detectors include a photo-detector, charged couple device and photodiode. Each light source is oriented to emit a light beam in a specific direction. Each light detector is aligned to detect light emitted from a corresponding light source, either directly or after being reflected by a media sheet, for example.

Together flag and optical sensors 90, 120 detect when a media sheet encounters a drive roller and the relative position of one or more edges of media sheets as they advance down path 5.

For one or more reasons, such as constraints imposed by a vacuum system used to hold media pages against drum 30 while they pass mechanism 20, the leading edge of each media sheet may need to engage a particular location on drum 30 (for example, at one or more loading positions). One such loading position is shown as position 31 in FIG. 1. In practice, tolerances for deviation from a loading position may be on the order of a few millimeters. In such a case, media sheets may be held (or staged) at position 5*d* (e.g., a staging position or location) until drum 30 is at an appropriate position. For example, the fifth motor that advances media sheets from position 5*d* to position 5*e*, such that they engage drum 30, may be halted once a media sheet is received. The fifth motor may be activated at a time when drum 30 reaches a position, such that the continued rotation of drum 30 and activation of the fifth motor is expected to result in a leading edge of a staged media sheet to engage drum 30 at a loading position.

The leading edge of a media sheet may not always reach drum 30 when expected. If the leading edge of a staged media sheet does not engage drum 30 at a loading position (or within an allowable tolerance thereof), apparatus 10 may indicate a jam condition, and halt operation.

Referring still to FIG. 1, apparatus 10 may incorporate one or more additional sensors 200 and an encoder 210. Such an additional sensor and encoder may be used to mitigate the occurrence of jam conditions. In the illustrated embodiment, sensor 200 is positioned between the staging location and drum 30. In the illustrated embodiment, sensor 200 is positioned between at least one roller activated by the fifth motor and drum 30. In the illustrated embodiment, sensor 200 is positioned along media path 5 immediately before drum 30. According to an embodiment of the present invention, sensor 200 may take the form of an optical sensor. Accordingly, sensor 200 may incorporate a light source and a light detector. Exemplary light sources include a photo-emitter, LED, laser diode, super luminescent diode and fiber optic source. Exemplary light detectors include a photo-detector, charged couple device and photodiode. The light source is oriented to emit a light beam into path 5. The light detector is aligned to detect light emitted from the source, either directly or after being reflected by the media, for example. Other types of detectors, such as one or more flag sensors, may be used as sensor 200.

Encoder 210 may take the form of a motor position encoder. Encoder 210 may be embodied as firmware. Firmware, as used herein, generally refers to a combination of software and hardware. Encoder 210 is coupled to sensor 200, and responsive thereto to latch (e.g., output and hold) a value indicative of the position of motor 330 when sensor 200 detects the leading edge of a media sheet. The latched value is read by controller 70 and used to adjust the rate at which roller 220 delivers a media sheet to engage drum 30. In the illustrated embodiment, motor 330 serves as the fifth motor, and operates drive rollers 220 to advance media sheets from the staging location 5*d* to a position 5*e*, such that the media sheets engage drum 30. In the illustrated embodiment, motor 330 is coupled to, and responsive to controller 70. Controller 70 controls the rate at which roller 220 delivers a media sheet to engage drum 30.

According to an embodiment of the present invention sensor 200 may be positioned along the paper path about 1.5 inches from drum 30. According to an embodiment of the present invention, when transporting media between staging location 5D to sensor 200, encoder 210 is monitored by controller 70 and the control voltage to motor 330 is periodically adjusted in order to maintain a constant roller speed approximately equal to the drum 30 speed. For example, where motor 330 takes the form of a DC motor, a DC operating bias may be applied to motor 330 by or responsively to controller 70. The operating speed of motor 330 may be substantially proportional to the applied operating bias. The applied operating bias may be indicative of a nominal voltage component in addition to a correction voltage component (e.g., $V_{nominal} \pm V_{correction}$) where the nominal voltage component is expected to result in a desired motor speed (e.g., 30 inches/sec of media movement), and the correction voltage component alters or corrects the actual motor speed to match the desired motor speed. The correction voltage component may be determined and combined with the nominal voltage component using a motor position encoder coupled to a motor that is periodically checked by a controller, such as controller 70, to determine its actual speed.

When the media edge enters sensor 200, the encoder 210 value, which is indicative of motor 330 location or angular position, is latched and subsequently received by the controller 70. Controller 70 then adjusts the operating bias of motor 330 such that motor 330 velocity is adjusted. In other words, when sensor 200 detects a leading edge of an advancing media sheet, the value of encoder 210 is latched. The latched value is indicative of the position of motor 330 when sensor 200 was activated, and hence the distance motor 330 traveled when sensor 200 was activated. Controller 70 compares the latched value to a predetermined value indicative of a distance motor 330 was expected to have traveled when sensor 200 was activated. By way of further, non-limiting example only, when sensor 220 detects a media sheet leading edge, a value x±y is latched, where x is the value expected to be latched and y is a variance of the actual value latched from the expected value. Controller 70 then compares the latched x±y value to the x value, to determine the y value. Controller 70 then modifies or alters the motor 330 operating bias to offset the y value, such as by temporarily ramping the operating bias up or down, to correct for or mitigate the value y. In such a case, the operating bias may be akin to $V_{nominal} \pm V_{correction} \pm V_{correction\text{-}y}$, where the nominal voltage component is expected to result in a desired motor speed (e.g., 30 inches/sec of media movement), the correction voltage component alters or corrects the actual motor speed to match the desired motor speed, and the y-correction voltage component corresponds to the determine y value. The operating bias of others of motors 60 may analogously be modified to mitigate driving speed mismatch between motors engaging a common media sheet, for example.

Figure 2:
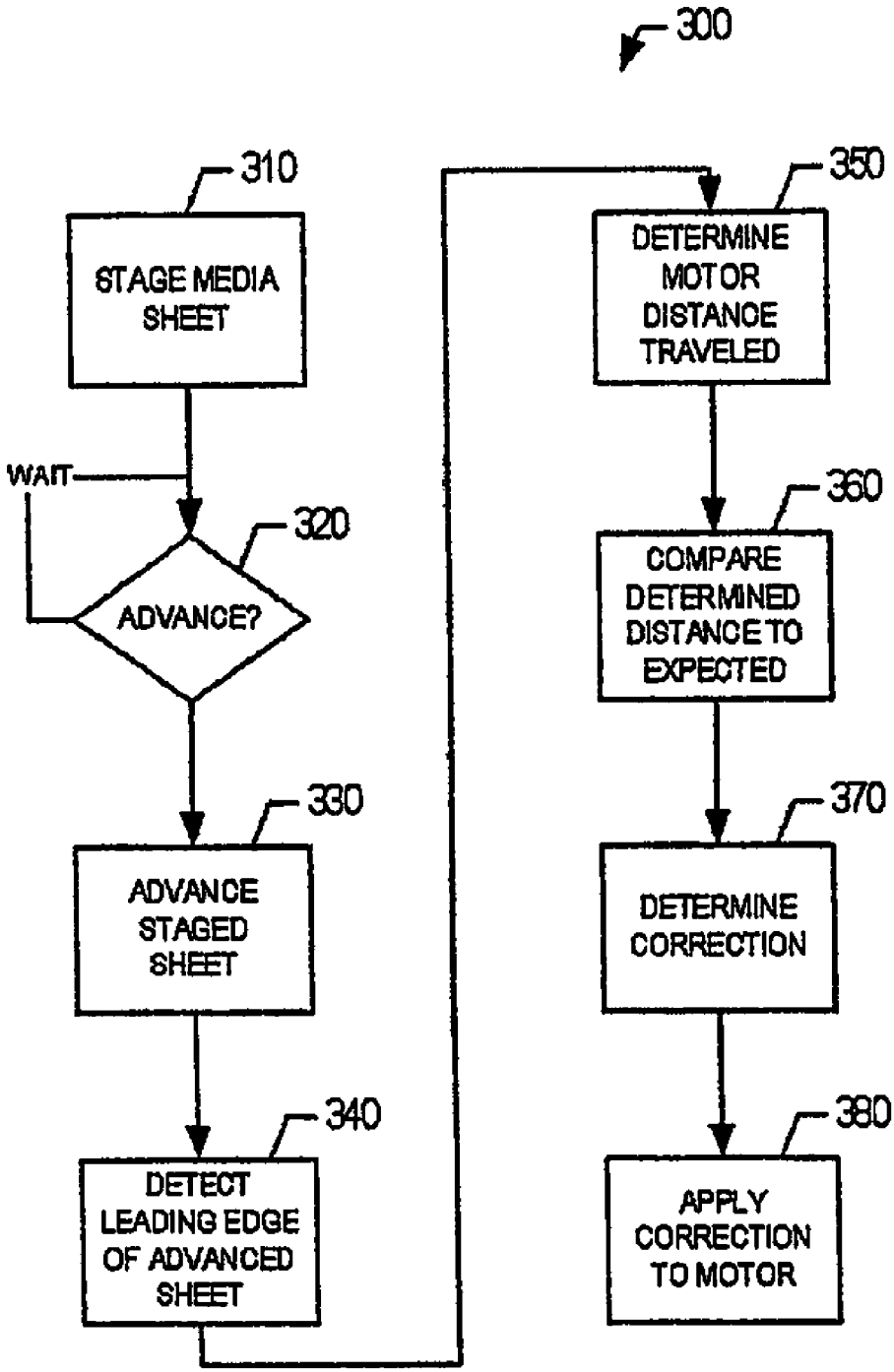

Referring now to FIG. 2, there is shown a flow diagram of a process 300 suitable for use with the system of FIG. 1 and according to an embodiment of the present invention. Process 300 begins with a media sheet being staged at block 310. Referring now also to FIG. 1, media staging at block 310 may typically involve transporting the media sheet from one of trays 82, 84, 86 along media path 5 to staging location 5*d*.

At block 320, it is determined whether the staged media sheet should be advanced. The leading edge of the media sheet may need to engage drum 30 at a particular location on drum 30 (i.e., at a loading position). In such an embodiment, it may be determined at block 320 when drum 30 is at an appropriate rotating position, such that starting to further advance the staged media sheet is expected to result in the leading edge of the media sheet engaging the drum at a loading position. When it is determined that drum 30 is at an appropriate location to begin further advancing the staged media sheet at block 320, the sheet is advanced at block 330 by a loading motor (e.g., the fifth motor).

The leading edge of the media sheet is detected at block 340 after it begins being advanced from the staging location. Referring again to FIG. 1, the leading edge of the staged media sheet advanced at block 330 may be detected at block 340 using sensor 200. At block 350, it is determined how far the loading motor has advanced or traveled since being activated at block 330 when the leading edge was sensed at block 340. According to an embodiment of the present invention, the distance the loading motor has traveled may be measured directly, such as by using encoder 210. According to an embodiment of the present invention, the distance the loading motor has traveled may be indirectly determined, such as by determining the length of the temporal period that has elapsed between the beginning of advancing a staged media sheet at block 330, and the time when the sensor positioned relative to the staging location detects the leading edge of the advancing media sheet at block 340.

At block 360, the distance traveled by the loading motor is compared to a distance the loading motor was expected to travel, to determine a difference. According to an embodiment of the present invention, the distance between the staging location (position 5*d*) and the location of sensor 200 is known. In such an embodiment, the distance the staged media loading motor (e.g., the fifth motor) has traveled between being activated at block 330 and the leading edge detection at block 340 is compared to the expected distance to determine a difference at block 360. Alternatively, the length of the temporal period between beginning to advance a staged media sheet at block 330 and when the leading edge of the advancing media sheet is detected at block 340 may be compared to an expected value to determine a difference at block 360.

At block 370, a correction is determined dependently upon the difference determined at block 360. For example, a correction value may be determined dependently upon the determined difference. The correction value may be applied at block 380 to controller 70, which in turn adjusts the rate at which the loading motor (e.g., fifth motor) transfers the staged media along media path 5 (e.g., accelerates or decelerates media sheet advancing on a sheet-by-sheet basis). Alternatively, the encoded correction may be applied at block 380 directly to and modulate operation of the loading motor (e.g., fifth motor).

By way of further non-limiting example, and according to an embodiment of the present invention, correction is applied by adjusting the motor velocity of the loading motor(s) 330 immediately after the media edge is sensed at sensor 200. When the media edge is sensed at sensor 200, the actual distance traveled from staging point 5D to sensor 200 is computed and compared to a predetermined value stored in the controller.

If the actual distance traveled, as sensed at sensor 200, is larger than the predetermined value, it indicates that the loading motor has traveled "slower" than the expected drum trajectory, and the relative position the media is lagging behind the drum loading location. In this case, the loading motor velocity is temporarily increased (accelerated) for a short period of time, then decreased (decelerated) back down to the original nominal velocity such that the velocity of the loading motor is again nominally matched to the velocity of the drum at the end of the correction move. The correction move follows a predetermined up-ramp and down-ramp table in order to advance the media location relative to the drum, such that the net increase in position (area change under the loading motor velocity curve) will compensate for the distance error detected at sensor 200. The length of up-ramp and down-ramp used is determined based on the amount of distance correction required.

If the actual distance traveled, as sensed at sensor 200, is smaller that the predetermined value, it indicates that the loading motor has traveled "faster" than the expected drum trajectory, and the relative position of the media ahead of the drum loading location. In this case, the loading motor velocity is temporarily decreased, then increased back up to the same nominal value, such that the media position is retarded relative to the drum position in order to correct for the distance error detected at sensor 200. Once again, the length of down-ramp and up-ramp used is computed real-time as a function of the correction amount required.

In such a manner, variations in media loading (e.g., mis-alignments between a media sheet leading edge and a loading location) due to a variety of factors may be compensated for in real-time, on a sheet-by-sheet basis.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A media handling system for delivering media sheets to be printed from a staging location to a drum along a media path, comprising:

at least one drive roller positioned along the media path between the staging location and the drum;

a sensor positioned along the media path between the at least one drive roller and the drum;

an encoder that provides an output responsive to the sensor;

a controller coupled to the encoder; and, at least one motor coupled to the drive roller, the at least one motor having an operating bias of $V_{nominal} \pm V_{correction}$;

wherein $V_{nominal}$ is a desired motor speed and $V_{correction}$ is an amount that an actual speed of the at least one motor is adjusted to match the desired motor speed; and wherein, when the at least one drive roller advances the media sheet from the staging location to engage the drum, the sensor detects a leading edge of the advancing media sheet prior to engaging the drum, a value indicative of a position of the at least one motor is latched and received by the controller in response to the sensor detecting the leading edge of the media sheet, the controller determines a difference between the latched value to a predetermined value indicative of a distance the motor was expected to have traveled, and the rate of further advancing of the media sheet to engage the drum by the at least one drive roller is dependent upon the encoder output and is adjusted by modifying the operating bias of the at least one motor such that the operating bias equals $V_{nominal} \pm V_{correction} \pm V_{correction\text{-}y}$, wherein $V_{correction\text{-}y}$ is the difference between the latched value and the predetermined value indicative of the distance the at least one motor was expected to have traveled.

2. The system of claim 1, wherein the controller accelerates the further advancing of the media sheet to engage the drum responsively to the encoder output.

3. The system of claim 1, wherein the controller decelerates the further advancing of the media sheet to engage the drum responsively to the encoder output.

4. The system of claim 1, wherein the rate of further advancing of the media sheet to engage the drum is dependent upon a determined distance the motor has traveled.

5. The media handling system of claim 1, wherein the further advancing of the media sheet to engage the drum is at a rate dependent upon the encoder output.

6. The media handling system of claim 1, wherein the sensor comprises an optical emitter and detector.

7. The media handling system of claim 1, wherein the sensor detects the leading edge of the advanced media sheet prior to the media sheet engaging the drum.

8. The media handling system of claim 1, wherein the at least one drive roller advances leading edges of the media sheets between the staging location and the sensor independent of the encoder output.

9. A method for delivering media sheets to be printed from a staging location to a drum along a media path, comprising:

advancing each of the media sheets from the staging location to the drum such that a leading edge of each advancing media sheet is expected to engage the drum at a predetermined loading location;

detecting an edge of each of the advancing media sheets on a sheet-by-sheet basis, said detecting being indicative of a mis-alignment between the leading edge of at least one of the advancing media sheets and the predetermined loading location on the drum;

determining, in response to detecting the edge of each of the advancing media sheets, a distance a loading motor has advanced, the loading motor having an operating bias of $V_{nominal} \pm V_{correction}$, wherein $V_{nominal}$ is a desired loading motor speed and $V_{correction}$ is an amount that an actual speed of the loading motor is adjusted to match the desired motor speed;

determining a difference between the distance the loading motor has advanced to a predetermined distance the loading motor was expected to travel; and, adjusting said advancing on a sheet-by-sheet basis dependently upon the difference by modifying the operating bias of the loading motor such that the operating bias equals $V_{nominal} \pm V_{correction} \pm V_{correction\text{-}y}$, wherein $V_{correction\text{-}y}$ is the difference between the distance the loading motor has advanced to the predetermined distance the loading motor was expected to travel, such that the detected mis-alignments are at least partially mitigated.

10. The method of claim 9, further comprising indicating a media sheet jam if the leading edge of an advancing media sheet actually engages the drum at a position different from the loading location.

11. The method of claim 9, wherein the adjusting comprises accelerating or decelerating the advancing of each of the media sheets.

12. A printing apparatus comprising:

an imaging mechanism;

a drum positioned relative to the imaging mechanism so as to advance media sheets past the imaging mechanism for printing by the imaging mechanism;

at least one drive roller positioned between a staging location and the drum so as to advance the media sheets;

a media handling system for delivering media sheets along a media path to the drum;

a media sheet edge sensor positioned along the media path between the at least one drive roller and the drum to detect a leading edge of the advancing media sheet;

an encoder responsive to the sensor and having an output;

a controller coupled to the encoder; and, at least one motor coupled to the drive roller, the at least one motor having an operating, bias of $V_{nominal} \pm V_{correction}$;

wherein $V_{nominal}$ is a desired motor speed and $V_{correction}$ is an amount that an actual speed of the at least one motor is adjusted to match the desired motor speed; and wherein, when the media sheet edge sensor detects the leading edge of the advancing media sheet, a value indicative of a position of the at least one motor is latched and received by the controller, the controller determines a difference between the latched value to a predetermined value indicative of a distance the motor was expected to have traveled, and when the difference is applied to the controller, a rate at which a media sheet is delivered to the drum is altered by modifying the operating bias of the at least one motor such that the operating bias equals $V_{nominal} \pm V_{correction} \pm V_{correction\text{-}y}$, wherein $V_{correction\text{-}y}$ is the difference between the latched value and the predetermined value indicative of the distance the at least one motor was expected to have traveled.

13. The printing apparatus of claim 12, wherein the encoder comprises firmware.

14. The printing apparatus of claim 12, wherein the imaging mechanism comprises a plurality of ink-jet pens.

15. The printing apparatus of claim 12, wherein the sensor is positioned upstream of the drum.

16. The printing apparatus of claim 12, wherein the sensor comprises an optical emitter and detector.

17. The printing apparatus of claim 12, wherein the media handling system accelerates or decelerates delivery responsively to the output.

* * * * *

UNITED STATES PATENT AND TRADEMARK OFFICE

CERTIFICATE OF CORRECTION

PATENT NO. : 7,914,099 B2
APPLICATION NO. : 11/724909
DATED : March 29, 2011
INVENTOR(S) : Loh et al.

It is certified that error appears in the above-identified patent and that said Letters Patent is hereby corrected as shown below:

In column 9, line 9, in Claim 12, delete "operating," and insert -- operating --, therefor.

Signed and Sealed this
Twenty-eighth Day of June, 2011

David J. Kappos

David J. Kappos
*Director of the United States Patent and Trademark Office*